US005507395A

United States Patent [19]

Wang et al.

[11] Patent Number: 5,507,395

[45] Date of Patent: Apr. 16, 1996

[54] METHOD OF DEPRESSING NON-SULFIDE SILICATE GANGUE MINERALS

[75] Inventors: Samuel S. Wang, Cheshire; D. R. Nagarai, Stamford, both of Conn.

[73] Assignee: Cytec Technology Corp., Wilmington, Del.

[21] Appl. No.: 475,161

[22] Filed: Jun. 7, 1995

[51] Int. Cl.[6] ..... B03D 1/02; B03D 1/008; B03D 1/016

[52] U.S. Cl. ..... 209/167; 252/61

[58] Field of Search ..... 209/167, 166, 209/901; 252/61

[56] References Cited

U.S. PATENT DOCUMENTS

| | | |
|---|---|---|
| 2,740,522 | 4/1956 | Aimone . |
| 3,929,629 | 12/1975 | Griffith . |
| 4,339,331 | 7/1982 | Lim . |
| 4,360,425 | 11/1982 | Lim . |
| 4,719,009 | 1/1988 | Furey . |
| 4,720,339 | 1/1988 | Nagaraj . |
| 4,744,893 | 5/1988 | Rothenberg . |
| 4,853,114 | 8/1989 | Lewis . |
| 4,866,150 | 9/1989 | Lipp . |
| 5,030,340 | 7/1991 | Panzer . |
| 5,057,209 | 10/1991 | Klimpel . |

*Primary Examiner*—Thomas M. Lithgow
*Attorney, Agent, or Firm*—F. M. Van Riet

[57] ABSTRACT

A method for the depression of non-sulfide, silicate gangue minerals is provided wherein the depressant is a graft polymer of polyvinyl alcohol and an acrylamide.

8 Claims, No Drawings

METHOD OF DEPRESSING NON-SULFIDE SILICATE GANGUE MINERALS

BACKGROUND OF INVENTION

The present invention relates to froth flotation processes for recovery of value sulfide minerals from base metal sulfide ores. More particularly, it relates to a method for the depression of non-sulfide silicate gangue minerals in the beneficiation of value sulfide minerals by froth flotation procedures.

Certain theory and practice states that the success of a sulfide flotation process depends to a great degree on reagents called collectors that impart selective hydrophobicity to the mineral value which has to be separated from other minerals.

Certain other important reagents, such as the modifiers, are also responsible for the successful flotation separation of the value sulfide and other minerals. Modifiers include, but are not necessarily limited to, all reagents whose principal function is neither collecting nor frothing, but usually one of modifying the surface of the mineral so that it does not float.

In addition to attempts at making sulfide collectors more selective for value sulfide minerals, other approaches to the problem of improving the flotation separation of value sulfide minerals have included the use of modifiers, more particularly depressants, to depress the non-sulfide gangue minerals so that they do not float along with sulfides thereby reducing the levels of non-sulfide gangue minerals reporting to the concentrates. A depressant is a modifier reagent which acts selectively on certain unwanted minerals and prevents or inhibits their flotation.

In sulfide value mineral flotation, certain non-sulfide silicate gangue minerals present a unique problem in that they exhibit natural floatability, i.e. they float independent of the sulfide value mineral collectors used. Even if very selective sulfide value mineral collectors are used, these silicate minerals report to the sulfide concentrates. Talc and pyrophyllite, both belonging to the class of magnesium silicates, are particularly troublesome in that they are naturally highly hydrophobic. Other magnesium silicate minerals belonging to the classes of olivines, pyroxenes, and serpentine exhibit various degrees of floatability that seems to vary from one ore deposit to the other. The presence of these unwanted minerals in sulfide value mineral concentrates causes many problems i.e. a) they increase the mass of the concentrates thus adding to the cost of handling and transportation of the concentrate, b) they compete for space in the froth phase during the flotation stage thereby reducing the overall sulfide value mineral recovery, and c) they dilute the sulfide concentrate with respect to the value sulfide mineral content which makes them less suitable, and in some cases unsuitable, for the smelting thereof because they interfere with the smelting operation.

The depressants commonly used in sulfide flotation include such materials as inorganic salts (NaCN, NailS, SO2, sodium metabisulfite etc) and small amounts of organic compounds such as sodium thioglycolate, mercaptoethanol etc. These depressants are known to be capable of depressing sulfide minerals but are not known to be depressants for non-sulfide minerals, just as known value sulfide collectors are usually not good collectors for non-sulfide value minerals. Sulfide and non-sulfide minerals have vastly different bulk and surface chemical properties. Their response to various chemicals is also vastly different. At present, certain polysaccharides such as guar gum and carboxy methyl cellulose, are used to depress non-sulfide silicate gangue minerals during sulfide flotation. Their performance, however, is very variable and on some ores they show unacceptable depressant activity and the effective dosage per ton of ore is usually very high (as much as 1 to 10 lbs/ton). Their depressant activity is also influenced by their source and is not consistent from batch to batch. Furthermore, these polysaccharides are also valuable sources of food i.e. their use as depressants reduces their usage as food and, storage thereof presents particular problems with regard to their attractiveness as food for vermin. Lastly, they are not readily miscible or soluble in water and even where water solutions thereof can be made, they are not stable, U.S. Pat. No. 4,902,764 (Rothenberg et al.) describes the use of polyacrylamide-based synthetic copolymers and terpolymers for use as sulfide mineral depressants in the recovery of value sulfide minerals. U.S. Pat. No. 4,720,339 (Nagaraj et al) describes the use of polyacrylamide-based synthetic copolymers and terpolymers as depressants for silicious gangue minerals in the flotation beneficiation of non-sulfide value minerals, but not as depressants in the benefication of sulfide value minerals. The '339 patent teaches that such polymers are effective for silica depression during phosphate flotation which also in the flotation stage uses fatty acids and non-sulfide collectors. The patentees do not teach that such polymers are effective depressants for non-sulfide silicate gangue minerals in the recovery of value sulfide minerals. In fact, such depressants do not exhibit adequate depressant activity for non-sulfide silicate minerals during the beneficiation of sulfide value minerals. U.S. Pat. No. 4,220,525 (Petrovich) teaches that polyhydroxyamines are useful as depressants for gangue minerals including silica, silicates, carbonates, sulfates and phosphates in the recovery of non-sulfide mineral values. Illustrative examples of the polyhydroxyamines disclosed include aminobutanetriols, aminopartitols, aminohexitols, aminoheptitols, aminooctitols, pentose-amines, hexose amines, amino-tetrols etc. U.S. Pat. No. 4,360,425 (Lim et al) describes a method for improving the results of a froth flotation process for the recovery of non-sulfide mineral values wherein a synthetic depressant is added which contains hydroxy and carboxy functionalities. Such depressants are added to the second or amine stage flotation of a double float process for the purpose of depressing non-sulfide value minerals such as phosphate minerals during amine flotation of the siliceous gangue from the second stage concentrate. This patent relates to the use of synthetic depressant during amine flotations only.

In view of the foregoing and especially in view of the teachings of U.S. Pat. No. 4,902,764 which teaches the use of certain polyacrylamide-based copolymers and terpolymers for sulfide mineral depression during the recovery of value sulfide minerals, we have unexpectedly found that certain polymers are indeed excellent depressants for non-sulfide silicate gangue minerals (such as talc, pyroxenes, olivines, serpentine, pyrophyllite, chlorites, biotites, amphiboles, etc). These synthetic depressants have now been found to be excellent alternatives to the polysaccharides used currently since they are readily miscible or soluble in water, are non-hazardous and their water solutions are stable. The use thereof will increase the availability of the polysaccharides as a valuable human food source and their performance is not variable. They can be manufactured to adhere to stringent specifications and, accordingly, batch-to-batch consistency is guaranteed. Unlike the polysaccharides which are natural products, these synthetic polymers lend themselves readily to modification of their structure, thereby permitting tailor-making of depressants for a given application.

SUMMARY OF THE INVENTION

In accordance with the present invention there is provided a method which comprises beneficiating value sulfide minerals from ores with the selective rejection of non-sulfide silicate gangue minerals by:

a. providing an aqueous pulp slurry of finely-divided, liberation-sized ore particles which contain said value sulfide minerals and said non-sulfide silicate gangue minerals;

b. conditioning said pulp slurry with an effective amount of non-sulfide silicate gangue mineral depressant, a value sulfide mineral collector and a frothing agent, said depressant comprising a polymer of polyvinylalcohol to which is grafted an acrylamide monomer and, optionally, a comonomer copolymerizable with said acrylamide monomer, or a mixture of said polymers, and c. collecting the value sulfide mineral having a reduced content of non-sulfide silicate gangue minerals by froth flotation.

DESCRIPTION OF THE INVENTION INCLUDING PREFERRED EMBODIMENTS

The depressants used in the present invention may comprise, as the grafted monomers, such acrylamides as acrylamide per se, alkyl acrylamides such as methacrylamide, ethacrylamide and the like.

The comonomers may comprise any monoethylenically unsaturated monomer copolymerizable with the acrylamide monomer such as hydroxyalkylacrylates and methacrylates e.g. 1,2-dihydroxypropyl acrylate or methacrylate; hydroxyethyl acrylate or methacrylate; glycidyl methacrylate, acrylamido glycolic acid; hydroxyalkylacrylamides such as N-2-hydroxyethylacrylamide; N-1-hydroxypropylacrylamide; N-bis( 1,2-dihydroxyethyl)acrylamide; N-bis(2-hydroxypropyl)acrylamide; and the like, acrylic acid; methacrylic acid; alkali metal or ammonium salts of acrylic and/or methacrylic acid; vinyl sulfonate; vinyl phosphonate; 2-acrylamido-2-methyl propane sulfonic acid; styrene sulfonic acid; maleic acid; fumaric acid; crotonic acid; 2-sulfoethylmethacrylate; 2-acrylamido-2-methyl propane phosphonic acid acrylonitrile; vinyl alkyl ethers, such as vinyl butyl ether, and the like.

The effective weight average molecular weight range of the polyvinylalcohols is surprisingly very wide, varying from at least about ten thousand, preferably from about thirty thousand to millions e.g. 2 million preferably to about 1 million.

The dosage of depressant useful in the method of the present invention ranges from about 0.01 to about 10 pounds of depressant per ton of ore, preferably from about 0.1 to about 5 lb./ton, most preferably from about 0,1 to about 1.0 lb./ton of ore.

When mixtures of the grafted polyvinylalcohol polymers discussed above are used as the depressant, they may be used in ratios of 9:1 to 1:9, preferably, 3:1 to 1:3, most preferably 3:2 to 2:3, respectively.

The weight ratio of the acrylamide to the polyvinyl alcohol in the depressants used herein should range from about 99 to 1 to about 1 to 1, preferably from about 10 to 1 to about 4 to 1 respectively. The concentration of the optional copolymerizable comonomers should be less than about 50%, as a weight percent fraction, preferably from about 1 to about 30% of the total monomers.

The acrylamide monomer grafted polyvinylalcohol may be prepared by any method known to those skilled in the art such as that taught in EPO-A-117978; Melnik et al; Dokl. Akad. Nauk Uter. SSR, Ser B; Geol. Khim. Brol. Nanki (6), 48–51, Russian 1987; Burrows et al; J. Photochem. Photobiol. A,63(1), 67–73, English, 1992. Generally, the acrylamide monomer, alone or in conjunction with the optional comonomer, may be grafted onto the polyvinylalcohol in the presence of ceric ion catalyst, e.g. ceric ammonium nitrate, as a catalyst at a temperature ranging from about 10°–50° with intermittent cooling for from about 2–6 hours. Termination of the reaction is effected after a constant solution viscosity is reached by raising the pH with diluted caustic solution to neutral or above. Generally, the amount of catalyst employed should range from about 0.3 to about 5.0%, by weight, based on the combined weight of monomers to be grafted, preferably from about 0.8 to about 4.0%, same basis, the preferred range resulting in a grafted polymer having a more effective depressant activity.

The new method for beneficiating value sulfide minerals employing the synthetic depressants of the present invention provides excellent metallurgical recovery with improved grade. A wide range of pH and depressant dosage are permissible and compatibility of the depressants with frothers and sulfide value mineral collectors is a plus.

The present invention is directed to the selective removal of non-sulfide silicate gangue minerals that normally report to the value sulfide mineral flotation concentrate, either because of natural floatability or hydrophobicity or otherwise. More particularly, the instant method effects the depression of non-sulfide magnesium silicate minerals while enabling the enhanced recovery of sulfide value minerals. Thus, such materials may be treated as, but not limited to, the following:

- Talc
- Pyrophyllite
- Pyroxene group of Minerals
  - Diopside
  - Augite
  - Homeblendes
  - Enstatite
  - Hypersthene
  - Ferrosilite
  - Bronzite
- Amphibole group of minerals
  - Tremolite
  - Actinolite
  - Anthophyllite
- Biotite group of minerals
  - Phlogopite
  - Biotite
- Chlorite group of minerals
- Serpentine group of minerals
  - Serpentine
  - Chrysotile
  - Palygorskite
  - Lizardite
  - Anitgorite
- Olivine group of minerals
  - Olivine
  - Forsterite Hortonolite
Fayalite The following examples are set forth for purposes of illustration only and are not to be construed as limitations on the present invention except as set forth in the appended claims, All parts and percentages are by weight unless otherwise specified. In the examples, the following designate the monomers used:

AMD=acrylamide
PVA=polyvinylalcohol
AA=acrylic acid
MAMD=methacrylamide
AN=acrylonitrile
VBE=vinylbutylether
t-BAMD=t-butylacrylamide
HPM=2-hydroxpropyl methacrylate
AMPP=2-acrylamido-2-methylpropane phosphonic acid
C=comparative Background Example 1

Preparation of Ceric Ammonium Nitrate catalyst solution 54.82 parts of ceric ammonium nitrate (0.1M) are dissolved in one liter of 1.0N nitric acid.

BACKGROUND EXAMPLE

Graft Copolymerization

To a solution of 5.0 parts of polyvinyl alcohol (mol. wt. approx. 10,000) in 150 parts of water, 30.9 parts of a 52% acrylamide monomer solution are added. With good agitation 5 parts of the above ceric catalyst solution are introduced slowly. The reaction mixture is kept at 25°–30° C. with intermittent cold water cooling. The graft polymerization is continued for 3 to 4 hours until a constant solution viscosity is obtained. The reaction is terminated by raising the pH of the mixture with diluted caustic solution to a neutral or slightly alkaline pH.

Background Examples 3 and 4

Following the above Example 2, graft copolymers of AMD and PVA of higher molecular weight, i.e., 20,000 and 50,000, are also prepared.

Background Example 5

A graft terpolymer is prepared by adding 30.9 parts of a 52% acrylamide monomer solution and 7.2 parts of acrylic acid monomer to a solution of 5.0 parts of PVA (mol. wt. 50,000) in 150 parts water. A total of 10 parts of ceric catalyst solution are used for this preparation. Other copolymers are prepared similarly, e.g. using acrylonitrile and vinyl butyl ether.

EXAMPLES 1–10

An ore containing approximately 3.3% Ni and 16.5% MgO (in the form of Mg silicates) is ground in a rod mill for 5 min. to obtain a pulp at a size of 81%–200 mesh. The ground pulp is then transferred to a flotation cell and is conditioned at natural pH (~8–8.5) with 150 parts/ton of copper sulfate for 2 min., 50 to 100 parts/ton sodium ethyl xanthate for 2 min. and then with the desired amount of a depressant and an alcohol frother for 2 min. First stage flotation is then conducted by passing air at approximately 3.5–5 l/min. and a concentrate is collected. In the second stage, the pulp is conditioned with 10 parts/ton of sodium ethyl xanthate, and specified amounts of the depressant and the frother for 2 min. and a concentrate is collected. The conditions used in the second stage are also used in the third stage and a concentrate is collected. All of the flotation products are filtered, dried and assayed.

The results for the depressant activity of two AMD/PVA graft copolymers are compared with that of guar gum and polyvinylalcohol in Table 1. In the absence of any depressant, the Ni recovery is 96.6% which is considered very high and desirable; the MgO recovery is 61.4% which is also very high, but considered highly undesirable. The Ni grade of 4.7% obtained is only slightly higher than that in the original feed. With guar gum at 420 and 500 parts/ton, the MgO recovery is in the range of 28.3 to 33.5% which is considerably lower than that obtained in the absence of a depressant, and Ni recovery is about 93% which is lower than that obtained in the absence of depressant. A reduction in Ni recovery is to be expected in the process of reducing MgO recovery since there is invariably some mineralogical association of Ni minerals with the Mg-silicates and, when the latter are depressed, some Ni minerals are also depressed. When the graft copolymers of the present invention are used, there is a much greater reduction in the MgO recoveries compared to that with guar gum. The Ni recoveries are also slightly lowered compared with that of guar gum, but the Ni grades in the concentrate are much higher than those obtained with guar gum. These findings indicate the very strong depressant activity of the graft copolymers at all of the dosages used. They also suggest that much lower dosages of the graft copolymers can be used; in this case the Ni recoveries would improve while maintaining the low MgO recoveries.

The results also demonstrate that when a polyvinyl alcohol polymer is used as is, i.e., without grafting to the AMD monomer, the metallurgical performance is poor; depressant activity is quite non-selective. The Ni recovery is greatly reduced (82.9% vs. the recovery of 88% for the graft copolymer under identical conditions). Thus the graft copolymer is much superior to as-is polyvinyl alcohol.

TABLE I

Feed Assay: 3.31% Ni and 17.58% MgO

| Example | Depressant | Parts/Ton | Ni Rec. | Ni Grade | MgO Rec. |
|---|---|---|---|---|---|
| 1C | None | 0 | 96.6 | 4.7 | 61.4 |
| 2C | Guar Gum | 350 + 70 + 80 | 93.0 | 7.7 | 28.3 |
| 3C | Guar Gum | 300 + 60 + 60 | 92.9 | 6.7 | 33.5 |
| 4 | AMD/ PVA(23K) 75/25 | 300 + 70 + 80 | 91.6 | 9.2 | 18.7 |
| 5 | AMD/ PVA(23K) 75/25 | 350 + 85 + 100 | 90.1 | 9.6 | 14.2 |
| 6 | AMD/ PVA(23K) 75/25 | 350 + 70 + 80 | 90.0 | 8.3 | 20.7 |
| 7 | AMD/ PVA(23K) 75/25 | 280 + 56 + 64 | 90.6 | 7.5 | 23.0 |
| 8 | AMD/ PVA(50K) 75/25 | 350 + 70 + 80 | 88.0 | 9.5 | 16.7 |
| 9 | AMD/ PVA(50K) 75/25 | 280 + 56 + 64 | 84.8 | 7.8 | 17.3 |
| 10C | PVA(50K) | 350 + 70 + 80 | 82.9 | 6.4 | 38.1 |

Examples 11–20

The gangue silicate minerals from the same ore as in Examples 1–10 are treated with a dosage of depressant of 1.0 lb./ton unless otherwise specified in accordance with the flotation procedure thereof. The results are set forth in Table II, below, the lower the value under the column heading % Recovery (gangue silicate) the better the depressant.

TABLE II

| Example | Depressant | % Recovery (Gangue Silicate) |
|---|---|---|
| 11C | None | 85 |
| 12C | Polyvinyl alcohol | 75 |
| 13C | Guar | 3.4 |
| 14 | 60/40 AMD/PVA | 8.9 |
| 15 | 75/25 AMD/PVA | 8.7 |
| 16 | 80/20 AMD/PVA | 3.0 |
| 17 | 87/13 AMD/PVA | 1.3 |
| 18 | 90/10 AMD/PVA | 0 |
| 19 | 92.5/7.5 AMD/PVA | 7.9 |
| 20 | 97.5/2.5 AMD/PVA | 7.8 |

Examples 21–24

A PVA graft copolymer is prepared in accordance with Background Examples 1–5 above, with varying amounts of ceric iron catalyst. The results are shown in Table III, below, following the flotation procedure of Examples 11–20.

TABLE III

| Example | Depressant | % Catalyst (Ce) | % Recovery (Gangue Silicate) |
|---|---|---|---|
| 21 | 75/25 AMD/PVA | 0.5 | 44.6 |
| 22 | 75/25 AMD/PVA | 1.3 | 8.7 |
| 23 | 75/25 AMD/PVA | 1.96 | 3.0 |
| 24 | 75/25 AMD/PVA | 2.6 | 2.6 |

Examples 25–28

The flotation procedure of Examples 11–20 is again followed except that different graft copolymers are employed. The results are set forth in Table IV below.

TABLE IV

| Example | Depressant | % Recovery (Gangue Silicate) |
|---|---|---|
| 25 | AMD/AN/PVA 80/10/10 | 7.75 |
| 26 | AMD/AN/PVA 85/5/10 | 3.28 |
| 27 | AMD/AA/PVA 66/24/10 | 16.60 |
| 28 | AMD/VBE/PVA 80/10/10 | 14.70 |

Examples 29–31

The flotation procedure of Examples 11–20 is again followed except that the molecular weight of the PVA is varied. The results are shown in Table 5, below.

TABLE V

| Example | Depressant | Molecular Wt. (PVA) | % Recovery (Gangue Silicate) |
|---|---|---|---|
| 29 | 90/10 AMD/PVA | 9–10K | 7.1 |
| 30 | 90/10 AMD/PVA | 13–23K | 4.6 |
| 31 | 90/10 AMD/PVA | 31–50K | 3.3 |

Example 32

The flotation procedure of Examples 1–10 is again followed except that the depressant is a 1:1 blend of the depressants of Example 8 and Example 27. Similar results are achieved.

We claim:

1. A method which comprises beneficiating value sulfide minerals from ores with selective rejection of non-sulfide silicate gangue minerals which comprises:

a. providing an aqueous pulp slurry of finely-divided, liberation-sized ore particles which contain said value sulfide minerals and said non-sulfide silicate gangue minerals;

b. conditioning said pulp slurry with an effective amount of non-silicate gangue mineral depressant, a value sulfide mineral collector and a frothing agent, said depressant comprising a polymer of polyvinylalcohol onto which is grafted an acrylamide and, optionally, a comonomer copolymerizable with said acrylamide, and c. subjecting said conditioned pulp slurry to froth flotation and collecting the value sulfide mineral having a reduced content of non-sulfide silicate gangue minerals.

2. A method according to claim 1 wherein the weight ratio of the acrylamide to the polyvinyl alcohol ranges from about 99 to 1 to about 1 to 1, respectively.

3. A method according to claim 1 wherein the graft polymer contains the comonomer in a finite amount of less than about 50 weight percent.

4. A method according to claim 1 wherein the molecular weight of the polyvinyl alcohol is at least about 10,000.

5. A method according to claim 1 wherein said graft polymer contains said commoner, said comonomer is selected from the group consisting of acrylonitrile, (meth-)acrylic acid and a vinylalkyl ether.

6. A method according to claim 1 wherein the weight ratio of the acrylamide to the polyvinyl alcohol ranges from about 10 to 1 to about 4 to 1.

7. A method according to claim 1 wherein the graft polymer contains from about 1 to about 30 weight percent of said comonomer.

8. A method according to claim 1 wherein the molecular weight of said polyvinyl alcohol is at least 30,000.

* * * * *